United States Patent [19]

Horodysky

[11] Patent Number: 4,778,610

[45] Date of Patent: Oct. 18, 1988

[54] ACID PHOSPHITES AS MULTIFUNCTIONAL ADDITIVES AND COMPOSITIONS THEREOF

[75] Inventor: Andrew G. Horodysky, Cherry Hill, N.J.

[73] Assignee: Mobil Oil Corporation, New York, N.Y.

[21] Appl. No.: 813,803

[22] Filed: Dec. 27, 1985

[51] Int. Cl.[4] ..... C10M 133/02; C10M 137/08

[52] U.S. Cl. ..... 252/32.5; 252/33.6; 252/49.9

[58] Field of Search ..... 252/32.5, 33.6, 49.9; 558/113

[56] References Cited

U.S. PATENT DOCUMENTS

| | | | |
|---|---|---|---|
| 2,272,668 | 11/1939 | Honel | 556/113 |
| 2,683,691 | 7/1954 | Thorpe et al. | 252/32.5 |
| 2,745,863 | 5/1956 | Otto | 252/32.5 |
| 3,207,586 | 9/1965 | Cizek | 252/32.5 |
| 3,557,001 | 1/1971 | Stanford et al. | 558/113 |
| 3,859,218 | 1/1975 | Jervis et al. | 252/32.5 |
| 3,979,308 | 9/1976 | Mead et al. | 252/49.9 |
| 4,215,002 | 7/1980 | Fein | 252/49.9 |
| 4,356,097 | 10/1982 | Papay | 252/49.8 |
| 4,599,191 | 7/1986 | Horodysky | 252/49.9 |
| 4,618,436 | 10/1986 | Horodysky | 252/49.9 |

*Primary Examiner*—Steven Capella
*Assistant Examiner*—Ellen McAvoy
*Attorney, Agent, or Firm*—Alexander J. McKillop; Michael G. Gilman; Howard M. Flournoy

[57] ABSTRACT

Lubricant compositions having enhanced friction-reducing/antiwear properties are provided by incorporating therein minor amounts of a compound or mixture of compounds which are the reaction product(s) of hydroxyhydrocarbyl hydrocarbyl amines and phosphorus pentoxide.

16 Claims, No Drawings

ACID PHOSPHITES AS MULTIFUNCTIONAL ADDITIVES AND COMPOSITIONS THEREOF

BACKGROUND OF THE INVENTION

This invention relates to compositions comprising lubricants and greases thereof containing a minor friction reducing amount of an internal acid phosphate salt of an alkoxylated amine and to the alkoxylated amine-derived phosphates themselves as lubricant additive products.

The metal surfaces of machinery or engines operate under heavy or normal loads wherein the metal is under friction, even when being lubricated. Thus, there is always metal wear which in some cases can be excessive. It is clear that lubricants used to protect the metal surfaces do not completely prevent wear at the points of metal to metal contact. Consequently, the performance of the machine or engine will suffer, and in aggravated cases the machine or engine may become completely inoperative from the wear caused by the friction.

There have been many attempts to devise additive systems to improve the friction properties of a lubricant. The non-metallic derivatives of the present invention provide lubricating oil compositions with enhanced friction characteristics and are believed to be capable of overcoming some of the deficiencies of prior art additives.

The use of ethyoxylated and propoxylated amines such as ethoxylated oleylamine or propoxylated tallowamine has been well known for their surfactant and lubricity properties when formulated into lubricating oils and for their water-scavenging and antirust characteristics when blended into fuels.

The use of phosphorus containing lubricating additives have also found widespread use. Phosphonates have been found to be lubricity and antiwear agents as exemplified by U.S. Pat. Nos. 4,356,097 and 4,532,057 which describe the use of hydrocarbyl phosphonates in lubricant formulations as friction modifiers.

However, no art is known to applicant that teaches or suggests the reaction products of the present invention.

SUMMARY OF THE INVENTION

It has now been found that lubricant compositions containing small additive concentrations of reaction products of (a) hydroxyhydrocarbyl hydrocarbyl amines or bis(hydroxyhydrocarbyl) hydrocarbyl amines, with (b) phosphorus pentoxide to form zwitterionic salts of alkoxylated amine acid phosphates possess excellent friction-reducing properties. Moreover, the exceptional surface activity of these novel compositions coupled with the acid phosphate moiety within the molecule, provide the basis for significant antiwear activity. These unique hydroxy alkylated amines or hydroxy alkylated diamine-derived acid phosphates provide a unique combination of friction-reducing properties and greater potential antiwear activity than is found in traditional prior art acid phosphates.

Although we do not want to be held to a specific theory, the acid phosphate moiety and alkoxylated amine moiety are believed to be present on the same zwitterionic species and not present on separate atoms as in prior art compositions.

Accordingly this invention is particularly directed to lubricant compositions comprising a major proportion of an oil of lubricating viscosity or grease prepared therefrom and a minor friction-reducing/antiwear amount of a compound or mixture of compounds obtained by reacting a hydroxyhydrocarbyl or poly(hydroxyhydrocarbyl) hydrocarbyl amines or diamines, bis(hydroxyhydrocarbyl) hydrocarbyl amines or diamines with phosphorus pentoxide. Hydrocarbyl is preferably alkyl or alkenyl.

DESCRIPTION OF PREFERRED EMBODIMENTS

The nature of the reaction that occurs when hydroxyhydrocarbyl hydrocarbyl amines are reacted with $P_2O_5$ is complex but a mixture of phosphorus-containing products is believed to form during the initial reaction, at least a portion of which is believed to contain the zwitterionic (internal) alkoxylated amine acid phosphate salt.

Hydroxyhydrocarbyl [and bis(hydroxyhydrocarbyl)] and poly(hydroxyhydrocarbyl) hydrocarbyl amines or diamines are converted to their corresponding acid phosphate salts by reaction with molar quantities, or less than molar quantities of a phosphorus oxide such as phosphorus pentoxide as exemplified below:

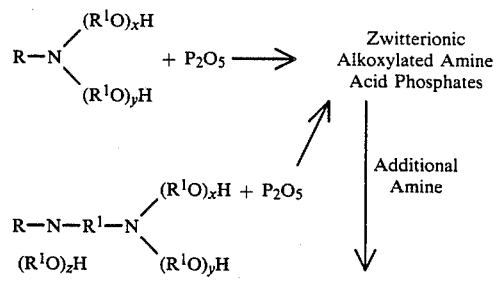

where:

R is $C_6$–$C_{30}$ hydrocarbyl, preferably $C_{10}$–$C_{20}$ alkyl or alkenyl and can additionally contain S, Cl, and the like;

$R^1$ is $C_2$ to $C_6$ hydrocarbylene, straight chain, branched or cyclic;

x, y, and z can be 0 to 15 provided that the sum of x and y, or x, y and z, where applicable are equal to at least 1.

The resultant alkoxylated amine acid phosphate may then be reacted with additional amine. The additional amine used is chosen from any suitable organic nitrogenous material such as alkyl amines including oleylamine or t-alkylamines, hydrocarbyl hydrocarbylene diamines such as N-tallow-1,3-propylenediamine, oxazolines, imidazolines, alkoxylated amines and the like having from 1 to about 30 carbon atoms or more.

Less than molar quantities, molar quantities or more than molar quantities of phosphorus pentoxide can be advantageously used. The alkoxylated amine acid phosphate can then, as noted hereinabove, be treated with the additional amine. The reactants are preferably used in equimolar amounts or within +50% of molar quantities.

The temperature is not believed to be critical and the reaction can be run over a wide range of from about 60° C. to about 225° C., preferably from about 70° C. to about 150° C. Although a solvent is not required, where one is used, it should be one in which the products are soluble and which can be relatively easily removed, however, in some cases a lubricating oil can be used as a solvent and diluent. Examples of useful solvents are toluene, benzene, xylene, hexane, ethanol and the like.

The temperatures of reaction will then depend upon the solvent used, since the reaction will generally be run at the temperature of reflux.

Times of reaction are not critical, but they will vary depending upon the molecular size and complexity of the reactants. Under normal conditions, the reaction with the contemplated reactants can be completed in from about 1 hour to about 10 hours, preferably from about 2 hours to about 6 hours.

The compounds of the invention are used with lubricating oils or greases to the extent of from about 0.1% to about 10% by weight of the total composition, preferably from about 0.2% to about 2 wt. %. Other additives, such as detergents, dispersants, antioxidants, antiwear agents, extreme pressure additives, pour depressants, antirust additives and the like may be present in the composition for their known purposes. These may include phenates, sulfonates, succinimides, zinc dithiophosphates, polymers, calcium and magnesium containing additives and the like. Up to above 10% by weight of such additives may be present.

The lubricant oils contemplated for use herein include mineral and synthetic hydrocarbon oils of lubricating viscosity, synthetic oils and mixtures of mineral and synthetic oils of lubricating viscosity. In general, mineral oils, both paraffinic, naphthenic, aromatic, and mixtures thereof, employed as the lubricant, or grease vehicle, may be of any suitable lubricating viscosity range, as for example from about 45 SSU at 100° F. to about 6,000 SSU at 100° F., and preferably, from about 50 to about 250 SSU at 210° F. These oils may have viscosity indexes ranging to about 100 or higher. Viscosity indexes from about 70 to about 95 are preferred. The average molecular weights of these oils may range from about 250 to about 800.

Where the lubricant is to be employed in the form of a grease, the lubricating oil is generally employed in an amount sufficient to balance the total grease composition, after accounting for the desired quality of the thickening agent, and other additive components to be included in the grease formulation. A wide variety of materials may be employed as thickening or gelling agents. These may include any of the conventional metal salts or soaps, such as lithium hydroxy stearate soaps, which are dispersed in the lubricating vehicle in grease-forming quantities in such degree as to impart to the resulting grease composition the desired consistency. Other thickening agents that may be employed in the grease formulation may comprise the non-soap thickeners, such as surface-modified clays and silicas, aryl ureas, calcium complexes and similar materials. In general, grease thickeners may be employed which do not melt and dissolve when used at the required temperature within a particular environment; however, in all other respects any material which is normally employed for thickening or gelling hydrocarbon fluids for forming grease can be used in preparing the aforementioned improved grease in accordance with the present invention.

In instances where synthetic oils, or synthetic oils employed as the vehicle for the grease, are desired in preference to mineral oils, or in combination therewith, various compounds of this type may be successfully utilized. Typical synthetic vehicles include polyisobutylene, polybutenes, hydrogenated polydecenes, polypropylene glycol, polyethylene glycol, trimethylol propane esters, neopentyl and pentaerythritol esters, di(2-ethylhexyl)sebacate, di(2-ethylhexyl)adipate, dibutyl phthalate, fluorocarbons, silicate esters, silanes, esters of phosphorus-containing acids, liquid ureas, ferrocene derivatives, hydrogenated mineral oils, chain-type polyphenyls, siloxanes and silicones (polysiloxanes), alkyl-substituted diphenyl ethers typified by a butyl-substituted bis(p-phenoxy phenyl)ether, phenoxy phenylethers.

The following examples and data will serve to illustrate the products of reaction disclosed herein and the lubricant compositions containing same. It is not intended that they serve as limitations, various modifications can be employed, as will be readily apparent to those skilled in the art.

EXAMPLE 1 bis(2-Hydroxyethyl)Oleylamine Acid Phosphate Product

Approximately 175 g (~½ mole) of bis(2-hydroxyethyl)oleylamine (commercially obtained as Ethomeen 0/12 from Armak Chemical Co.) and 100 g hexane were placed into a stirred reactor equipped with an inert nitrogen atmosphere and heated to about 70° C. Approximately 17 g phosphorus pentoxide were added over a 1-hour period of time. The reactants were then heated up to about 130° C. while removing solvent for approximately 5 hours. At this point, 175 g of 100" solvent paraffinic neutral lubricating oil was added as a diluent oil to reduce viscosity and improve handling. The solution was removed by vacuum distillation and the product was filtered through diatomaceous earth. The clear amber-colored liquid additive concentrate in oil was found to contain 1.8% phosphorus and 1.8% nitrogen.

EXAMPLE 2 bis(2-Hydroxyethyl)Oleylamine Acid Phosphate Product

Approximately 350 g (~1 mole) of bis(2-hydroxyethyl)oleylamine and 100 g hexane were warmed in a stirred reactor equipped with an inert nitrogen atmosphere. Approximately 23 g phosphorus pentoxide were added over a period of about 1½ hours. The temperature was raised to 100° C. for 1 hour and 120° C. for 2 hours while removing solvent by distillation. The crude product was vacuum topped at 130° C. and filtered hot through paper. The product is a viscous clear liquid.

EXAMPLE 3 bis(2-Hydroxyethyl)Oleylamine Acid Phosphate Product

Approximately 175 g (~½ mole) of bis(2-hydroxyethyl)oleylamine, 100 g hexane and 35 g phosphorus pentoxide were reacted as generally described in Example 1 at up to 130° C. for 5 hours. The reaction mixture was diluted to reduce viscosity with 175 g of 100" solvent paraffinic neutral lubricating oil. The solvent was removed by vacuum topping and the product was filtered through diatomaceous earth. The product contained 4.0% phosphorus and 2.0% nitrogen.

EXAMPLE 4 bis(2-Hydroxyethyl)Cocoamine Acid Phosphate Product

Approximately 280 g of bis(2-hydroxyethyl)cocoamine (commercially obtained as Ethamen C/12 from Armak Chemical Co.), 100 g of toluene and 35 g phosphorus pentoxide were reacted as generally described in Example 1. The reactants were then heated to about 100° C. for 2 hours, 120° C. for 2 hours and then vacuum topped at about 130° C. to remove residual solvent. The crude product was filtered through diatomaceous earth. The product contained 3.9% nitrogen.

EXAMPLE 5 bis(2-Hydroxyethyl)Oleylamine Acid Phosphate Reaction Product

Approximately 350 g (~1 mole) bis(2-hydroxyethyl-)oleylamine, 100 g hexane and 35 g phosphorus pentoxide were reacted in nitrogen atmosphere as generally described in Example 1 at 100° C. for 2 hours, and at 120° C. for 2 hours until clear. The reactants were vacuum topped at about 130° C. to remove residual solvent, and filtered hot through paper to form a very viscous clear amber product.

The products of selected examples were blended into fully formulated lubricants and evaluated for friction modifying properties using the Low Velocity Friction Apparatus as described below. Tables 1 and 2 contain the test data.

Low Velocity Friction Apparatus (LVFA)

The Low Velocity Friction Apparatus (LVFA) is used to measure the friction of test lubricants under various loads, temperatures, and sliding speeds. The LVFA consists of a flat SAE 1020 steel surface (diam. 1.5 in.) which is attached to a drive shaft and rotated over a stationary, raised, narrow ringed SAE 1020 steel surface (area 0.08 in$^2$). Both surfaces were submerged in the test lubricant. Friction between the steel surfaces is measured using a torque arm strain gauge system. The strain gauge output, which is calibrated to be equal to the coefficient of friction, is fed to the Y axis of an X–Y plotter. The speed signal from the tachometer-generator is fed to the X-axis. To minimize exteral friction, the piston is supported by an air bearing. The normal force loading the rubbing surfaces is regulated by air pressure on the bottom of the piston. The drive system consists of an infinitely variable-speed hydraulic transmission driven by a ½ HP electric motor. To vary the sliding speed, the output speed of the transmission is regulated by a lever cam motor arrangement.

Procedure

The rubbing surfaces and 12–13 ml. of test lubricant are placed on the LVFA. A 500 psi load is applied, and the sliding speed is maintained at 40 fpm at ambient temperature for a few minutes. A plot of coefficients of friction ($U_k$) over a range of sliding speeds, 5 to 40 fpm (25–195 rpm), is obtained. A minimum of three measurements is obtained for each test lubricant. Then, the test lubricant and specimens are heated to 250° F., another set of measurements is obtained, and the system is run for 50 minutes at 250° F., 500 psi, and 40 fpm sliding speed. Freshly polished steel specimens are used for each run. The surface of the steel is parallel ground to 6 to 8 microinches. The percentages by weight are percentages by weight of the total lubricating oil composition, including the usual additive package. The data are percent decrease in friction according to:

$$\frac{(U_k \text{ of oil alone}) - (U_k \text{ of Additive plus oil})}{(U_k \text{ of oil alone})} \times 100$$

Thus, the corresponding value for the oil alone would be zero for the form of the data used in the tables below.

TABLE 1

LOW VELOCITY FRICTION APPARATUS TEST

| | Concentration in Test Oil Wt. % | LVFA Test Results Reduction in Coefficient of Friction % 5 Ft/min | 30 Ft/min |
|---|---|---|---|
| Test Oil A, fully formulated mineral oil based automotive engine oil containing detergent/dispersant/inhibitor/antiwear performance package (SAE 10W40) | — | 0 | 0 |
| Example 1. Oil diluted bis(2-hydroxyethyl)oleylamine acid phosphate product concentrate | 1.0[1] | 37 | 33 |
| | 2.0[2] | 33 | 30 |
| Example 2. bis(2-hydroxyethyl) oleylamine acid phosphate product | 2.0 | 22 | 30 |
| Example 4. bis(2-hydroxyethyl)-cocoamine acid phosphate product. | 2.0 | 36 | — |

[1]This corresponds to an actual additive concentration of about 0.5%.
[2]This corresponds to an actual additive concentration of about 1.0%.

TABLE II

LOW VELOCITY FRICTION APPARATUS TEST

| | Concentration in Test Oil Wt. % | LVFA Test Results Reduction in Coefficient of Friction % 5 Ft/min | 30 Ft/min |
|---|---|---|---|
| Test Oil B, fully formulated synthetic based automotive engine oil containing detergent/dispersant/inhibitor/antiwear performance package (SAE 5W30) | — | 0 | 0 |
| Example 1. Oil diluted bis(2- | 2.0[1] | 22 | 30 |

TABLE II-continued

LOW VELOCITY FRICTION APPARATUS TEST

| | Concentration in Test Oil | LVFA Test Results Reduction in Coefficient of Friction % | |
|---|---|---|---|
| | Wt. % | 5 Ft/min | 30 Ft/min |
| hydroxyethyl)oleylamine acid phosphate product concentrate | | | |
| Example 4. bis(2-hydroxyethyl) cocoamine acid phosphate product | 2.0 | 36 | 18 |
| Example 5. bis(2-hydroxyethyl) oleylamine acid phosphate product | 2.0 | 54 | 30 |

[1]This corresponds to an actual additive concentration of about 1%.

The results clearly show the effectiveness of acid phosphates in accordance with the invention. An additive concentration of only 0.5% (on a neat, oil-free basis) of Example 1 was found to reduce friction by up to 37% as shown in Table I. Reduction in friction of up to 54% is shown in Table II.

The use of small additive concentrations of alkoxylated amine acid phosphates significantly enhance lubricants' energy efficiency and friction modifying/antiwear characteristics. These novel compositions described are useful at concentrations as low as 0.25 to 0.50 wt. %, are ashless and do not contain any potentially undesirable sulfur or metallic salts. These zwitterionic amine acid phosphates can be readily prepared in a simple one-step, one-pot process.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

What is claimed is:

1. A lubricant composition comprising a major proportion of an oil of lubricating viscosity or a grease prepared therefrom and a minor friction-reducing/antiwear amount of a compound or mixture of compounds obtained by reacting (1) a hydroxyhydrocarbyl or polyhydroxyhydrocarbyl hydrocarbyl amine or diamine or a bis(hydroxyhydrocarbyl) hydrocarbyl amine or diamine having the following generalized formulae

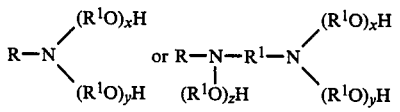

where R is $C_6$–$C_{30}$ hydrocarbyl, $R^1$ is $C_2$–$C_6$ hydrocarbylene, and x, y and z are 0 to about 15 with the proviso that x+y or x+y+z must be at least 1, and (2) phosphorus pentoxide and wherein at least a portion of said product is hydroxyalkylated or polyhydroxyalkylated amine-derived zwitterionic acid phosphate.

2. The composition of claim 1 wherein said friction-reducing/antiwear compound(s) and/or mixtures thereof is further reacted with up to molar amounts of additional organic nitrogenous basic material selected from the group consisting of alkyl amines or diamines, t-alkylamines, hydrocarbyl, hydrocarbylene diamines and alkoxylated amines or diamines having from 1 to about 30 carbon atoms or more.

3. The composition of claim 2 wherein the additional organic nitrogenous basic material is N-tallow-1,3 propylenediamine.

4. The composition of claim 1 wherein said amine or diamine is bis(2-hydroxyethyl)oleylamine.

5. The composition of claim 1 wherein said amine or diamine is bis(2-hydroxyethyl) cocoamine.

6. The composition of claim 1 wherein said major proportion is an oil of lubricating viscosity.

7. The composition of claim 6 wherein said oil is selected from mineral and synthetic oils and mixtures therof.

8. The composition of claim 7 wherein said oil is a mineral oil.

9. The composition of claim 8 wherein said oil is a synthetic oil.

10. The composition of claim 1 wherein said major amount is a grease.

11. The composition of claim 1 wherein said minor amount is present in an amount varying from about 0.1 to about 10 wt. % based on the total weight of the composition.

12. In a process of reducing friction and antiwear in an internal combustion engine comprising the improvement wherein the internal combustion engine is treated with a lubricant composition comprising a major proportion of an oil of lubricating viscosity or a grease prepared therefrom and a minor friction-reducing/antiwear amount of a compound or mixture of compounds obtained by reacting (1) a hydroxyhydrocarbyl or polyhydroxyhydrocarbyl hydrocarbyl amine or diamine or a bis(hydroxyhydrocarbyl) hydrocarbyl amine or diamine having the following generalized formulae

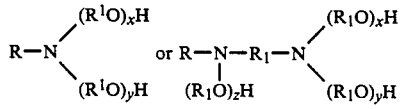

where R is $C_6$–$C_{30}$ hydrocarbyl, $R^1$ is $C_2$–$C_6$ hydrocarbylene, and x, y and z are 0 to about 15 with the proviso that x+y or x+y+z must be at least 1, and (2) phosphorus pentoxide and wherein at least a portion of said product is a hydroxyalkylated or polyhydroxyalkylated amine-derived zwitterionic acid phosphate.

13. The process described in claim 12 wherein said friction-reducing/antiwear compound(s) and/or mixtures thereof is further reacted with up to molar amounts of additional organic nitrogenous basic material selected from the group consisting of alkyl amines or diamines, t-alkylamines, hydrocarbyl, hydrocarbylene diamines and alkoxylated amines or diamines having from 1 to about 30 carbon atoms or more.

14. The process of claim 13 wherein the additional organic nitrogenous basic material is N-tallow-1,3 propylenediamine.

15. The process of claim 14 wherein said amine or diamine is bis(2-hydroxyethyl)oleylamine.

16. The process of claim 15 wherein said amine or diamine is bis(2-hydroxyethyl)cocoamine.

* * * * *